US005182079A

United States Patent [19]

Nelson

[11] Patent Number: 5,182,079

[45] Date of Patent: Jan. 26, 1993

[54] METALLIC COMPOSITION AND PROCESSES FOR USE OF THE SAME

[75] Inventor: Jerry L. Nelson, Mt. Clemens, Mich.

[73] Assignee: Nelson & Associates Research, Inc., Mt. Clemens, Mich.

[21] Appl. No.: 729,644

[22] Filed: Jul. 15, 1991

Related U.S. Application Data

[63] Continuation-in-part of Ser. No. 553,797, Jul. 17, 1990, Pat. No. 5,055,253.

[51] Int. Cl.[5] ..... C22C 38/42; C21D 9/00

[52] U.S. Cl. ..... 420/87; 420/91; 420/112; 148/637; 148/579

[58] Field of Search ..... 420/87, 91, 112; 148/12 B, 12.4, 637, 579

[56] References Cited

U.S. PATENT DOCUMENTS

| | | | |
|---|---|---|---|
| 3,615,905 | 10/1971 | Omsen et al. | 148/12.4 |
| 3,660,174 | 5/1972 | Jakenberg | 148/12 |
| 3,834,951 | 9/1974 | Jakenberg | 148/36 |
| 3,867,135 | 2/1975 | Johnson et al. | 75/60 |
| 3,888,956 | 6/1975 | Klint | 264/5 |
| 3,898,079 | 8/1975 | Eriksson | 75/60 |
| 3,918,692 | 11/1975 | Oberg | 266/35 |
| 3,942,978 | 3/1976 | Oberg et al. | 75/51 |
| 4,046,598 | 9/1977 | Janzon | 148/12 R |
| 4,115,111 | 9/1978 | Itoh et al. | 75/128 P |
| 4,236,096 | 11/1980 | Tiemann | 313/1 |
| 4,236,920 | 12/1980 | Lampe et al. | 75/128 A |
| 4,276,085 | 6/1981 | Wisell | 75/126 C |
| 4,428,781 | 1/1984 | Norstrom | 148/36 |
| 4,673,433 | 6/1987 | Roberts | 75/53 |
| 4,765,849 | 8/1988 | Roberts | 148/335 |
| 4,863,515 | 9/1989 | Roberts et al. | 75/238 |
| 5,055,253 | 10/1991 | Nelson | 420/87 |

FOREIGN PATENT DOCUMENTS

| | | | |
|---|---|---|---|
| 432224 | 11/1974 | U.S.S.R. | 420/91 |
| 592866 | 2/1978 | U.S.S.R. | 420/91 |

OTHER PUBLICATIONS

"The Making, Shaping and Treating of Steel", Ed. Harold E. McGannon, United States Steel, 9th Edition, copyright 1971, Chapters, 39, 42, 43, 44, 46, 47, 48 and 51.

"Guide to Tooling Materials", Penton Publishing, Inc., copyright 1987.

"Heat Treater's Guide", American Society for Metals, copyright 1982, pp. 450–451.

"Tool Steels", 4th Edition, American Society for Metals, copyright 1980, pp.227–250.

R. A. Grange et al., "Effect of Copper on the Heat Treating Characteristics of Medium-Carbon Steel", Transactions of the ASM, vol. 51, pp. 377–393.

M. R. Krishnadev et al. "Copper-Boron Low Alloy High Strength Steels", updated.

*Primary Examiner*—Deborah Yee

*Attorney, Agent, or Firm*—Renner, Otto, Boisselle, & Sklar

[57] ABSTRACT

The invention provides a novel metallic composition and method of using the same. More particularly, the invention affords a tool steel and a method of heat treating the tool steel. In one of the preferred embodiments the tool steel includes about 0.50 to about 0.65 percent by weight carbon, about 0.090 to about 1.45 percent by weight manganese, up to about 0.030 percent by weight phosphorus, about 0.035 to about 0.070 percent by weight sulfur, about 1.10 to about 1.90 percent by weight chromium, about 0.15 to about 0.40 percent by weight nickel and about 0.20 to about 0.40 percent by weight copper. In one of the preferred embodiments of the present invention the tool steel is heat treated utilizing a heat treatment schedule that includes the steps of a preheat, austenization and a double temper.

19 Claims, 1 Drawing Sheet

METALLIC COMPOSITION AND PROCESSES FOR USE OF THE SAME

RELATED APPLICATIONS

This application is a continuation-in-part of patent application Ser. No. 07/553,797 filed Jul. 17, 1990 now U.S. Pat. No. 5,055,253 entitled as filed METALLIC COMPOSITION.

The present invention concerns a metallic composition and a method of using the same. More particularly, the invention concerns a tool steel and a method of using the tool steel to produce dies or similar items.

BACKGROUND

The prior art provides various tool steels for use in producing items such as tools and dies. Such tool steels are generally classified as: (i) relatively low-alloy tool steels having higher hardenability than plain carbon steels; (ii) intermediate alloy steels which usually contain elements such as tungsten, molybdenum or vanadium, which form hard, wear resisting carbides; and (iii) high speed tool steels containing large amounts of carbide forming elements which serve not only to furnish wear resisting carbides but also to promote secondary hardening and thereby increase resistance to softening at elevated temperatures.

The relatively low-alloy and intermediate tool steels are commonly employed to produce dies which are utilized to shape, form, bend, draw, cut or otherwise process low carbon steels, stainless steels, and aluminum Such materials prior to processing may assume any one of a variety of configurations such as, for example, bars, rods, strips or sheets. The automotive industry, which does a considerable amount of metal processing, utilizes various low-alloy and intermediate alloy tool steels to produce dies. Such dies are commonly employed in presses and are used to produce items such as, for example, hoods, fenders, roof decks and trunk lids. The automotive industry places some fairly critical demands upon the tool steels from which their dies are produced. More particularly, many automotive dies undergo a considerable amount of machining and grinding in order to allow the die to produce items of intricate shape and exacting size tolerances. Also, automotive dies are many times used to process a tremendous number of items and are thus subject to very long runs. Additionally, some automotive dies are very large in size and require a considerable amount of tool steel in their production. Thus preferably the tool steel does not include major amounts of expensive alloying elements because the cost of the tool steel itself can be a significant factor in the construction of the dies.

An example of one tool steel utilized by the automotive industry to produce dies is a tool steel sold by the Uddeholm Corporation of Sterling Heights, Mich., under the trademark FERMO. Generally, FERMO tool steel would be classified as a relatively low-alloy tool steel having about 0.45 to 0.52 percent by weight carbon, 0.75 to 1.05 percent by weight manganese, 0.40 to 0.80 percent by weight silicon, and 1.30 to 1.70 percent by weight chromium. FERMO tool steel is preferred by some automotive personnel because it tends not to distort during flame hardening. Also, FERMO tool steel may be welded cold thereby facilitating repair of the die while it is mounted in the press or similar machine. Thus, such dies do not have to be removed from the press thereby helping to minimize costly downtime Unfortunately, FERMO tool steels generally display a maximum Rockwell (R) hardness on the C-scale (Rc) of about 54 to 58. Thus, FERMO tool steel is generally not suited for long runs where a die is scheduled to be utilized to produce a great number of items or pieces.

An example of another tool steel utilized by the automotive industry includes about 0.85 to 1.0 percent by weight carbon, 0.20 to 0.30 percent manganese, 0.20 to 0.30 percent by weight silicon and 0.15 to 0.25 percent by weight vanadium. This tool steel is preferred by some automotive personnel because it can be repair welded in the press. However, flame hardening of this tool steel is conducted at a temperature of about 1,600° F. to 1,650° F. followed by a water quench. Unfortunately, distortion has been found many times to develop during this hardening treatment.

An example of another tool steel utilized by the automotive industry includes about 0.85 to 1.10 percent by weight carbon, 0.50 to 0.70 percent by weight manganese, 0.25 to 0.40 percent by weight silicon, 4.75 to 5.25 percent by weight chromium, 0.20 to 0.40 percent by weight vanadium and 0.95 to 1.20 percent by weight molybdenum. This tool steel is commonly flame hardened at a temperature of about 1,800° F. or higher and generally displays a Rockwell hardness on the C-scale of around 60. This tool steel usually cannot be repair welded while the die is in the press. Generally, the damaged die, or sections thereof, must be removed from the press and preheated prior to repair welding. This can be a time consuming process leading to costly downtime Another tool steel utilized in the automotive industry includes about 0.45 to 0.55 percent by weight carbon, 1.0 to 1.20 percent by weight manganese, 0.30 to 0.50 percent by weight silicon, 1.00 to 1.25 percent by weight chromium and 0.35 to 0.45 percent by weight molybdenum. This alloy is generally supplied in an annealed condition having a Brinell hardness number (BHN) of about 180 to 220. Flame hardening of this tool steel is generally conducted at a temperature of about 1,780° F. followed by a water quench to produce a Rockwell hardness on the C-scale of about 58 to 60. Problems experienced by some automotive personnel with this tool steel include distortion during flame hardening and a relatively low wear resistance.

Generally, the aforementioned steels are formed into dies while the tool steel is in an annealed and/or normalized condition. In order to attain this condition, such tool steels are generally annealed and/or subjected to a normalization treatment until the desired hardness is attained.

Relatively low alloy tool steels are also used in some applications to produce tools such as chisels An example of a tool steel that was at one time utilized to produce chisels contained about 0.35 percent by weight carbon, 0.70 percent by weight manganese, 0.45 percent by weight silicon, 0.80 percent by weight chromium, 0.30 percent by weight molybdenum and 0.30 percent by weight copper. This tool steel was preferred for such applications as chisels because of its tendency not to become brittle and break during use. This tool steel generally would not be used to produce dies because of its inability to consistently produce Rockwell hardnesses on the C-scale in excess of about 54.

SUMMARY OF INVENTION

The present invention provides a novel metallic composition. More particularly, the present invention provides a novel relatively low-alloy tool steel for use in producing tools, dies and other similar items. The tool steel is particularly well suited for use in producing dies for the automotive industry.

The tool steel affords various distinct advantages over many prior art tool steels. Specifically, the tool steel of the present invention may be flame hardened by a user with virtually no distortion. This allows an end user to finish machine and grind the die in a soft (i.e., pre-hardened) condition and flame harden the die while it is mounted in the press just prior to final die try out or just prior to production. Similarly, the tool steel allows the die to be repair welded while the die is mounted in the press or machine. Also, the tool steel allows the die to be finished while the tool steel is in a pre-hardened fully machinable condition having a Rockwell hardness on the C-scale of about 38 to about 40. The tool steel also provides case hardening depths of about three-sixteenths of an inch to about three-eighths of an inch during flame hardening thereby helping to ensure long runs for dies produced utilizing the tool steel. Furthermore, since the tool steel does not contain major amounts of expensive alloying elements, it is a relatively inexpensive material for use in the production of dies and similar items.

The tool steel includes up to about 0.95 percent by weight carbon, about 0.075 to about 1.60 percent by weight manganese, about 0.020 to about 0.090 percent by weight sulfur, about 1.0 to about 2.0 percent by weight chromium and about 0.10 to about 0.50 percent by weight nickel. Preferably, the tool steel also includes at least about 0.20 percent by weight copper. In another preferred embodiment the tool steel comprises about 0.50 to about 0.65 percent by weight carbon, about 0.090 to about 1.45 percent by weight manganese, up to about 0.030 percent by weight phosphorus, about 0.035 to about 0.070 percent by weight sulfur, about 1.10 to about 1.90 percent by weight chromium, about 0.15 to about 0.40 percent by weight nickel and about 0.20 to about 0.40 percent by weight copper.

Prior to converting the tool steel into a die, and subsequent to casting the tool steel, it is preferably subjected to a heat treatment schedule. During the heat treatment schedule for castings below about 120 pounds the tool steel is initially preheated, then austenitized, and finally double tempered. During the preheat, preferably the tool steel is heated to an equalization temperature of about 1,200° F. and soaked for about two hours for every inch of cross section based upon the heaviest section of the tool steel. While the tool steel is in the furnace at temperature the austenization cycle is initiated. During austenization the tool steel is preferably heated to an equalization temperature of about 1,650° F. for one hour for each inch of cross section based upon the heaviest section of the tool steel and then taken down to an equalization temperature of about 1,500° F. and held at this temperature for about one hour for each inch of cross section based upon the heaviest section of the tool steel. The tool steel is then quenched in oil held at a temperature of about 160° F. to about 175° F. During the first temper the tool steel is preferably heated to an equalization temperature of about 1,000° F. and held at temperature for about one hour for each inch of cross section based upon the heaviest section of the tool steel followed by air cooling to room temperature. During the second temper the tool steel is preferably heated to an equalization temperature of about 1,115° F. and held at temperature about one hour per inch of cross section based upon the heaviest section of the tool steel.

The above heat treatment schedule produces a Rockwell hardness on the C-scale of about 38 to about 40. In this condition, the tool steel may be easily worked into a tool, die or other item. Subsequent to working, the tool steel may then be flame hardened at a temperature of about 1,560° F. to produce a Rockwell hardness on the C-scale of between about 60 and 62 and a case depth of about three-sixteenths of an inch to about three-eighths of an inch.

The foregoing and other features of the invention are hereinafter more fully described and particularly pointed out in the claims, the following detailed description and the annexed drawings setting forth in detail certain illustrative embodiments of the invention, these being indicative, however, of but a few of the various ways in which the principles of the present invention may be employed.

DETAILED DESCRIPTION

The present invention provides a relatively low-alloy tool steel suitable for use in producing any one of a variety of items such as, for example, tools, dies, knives, punches and molds. However, the tool steel is particularly well suited for use in producing dies. The tool steel is particularly well suited to dies subject to demanding applications such as the dies employed by the automotive industry.

Figure 1:
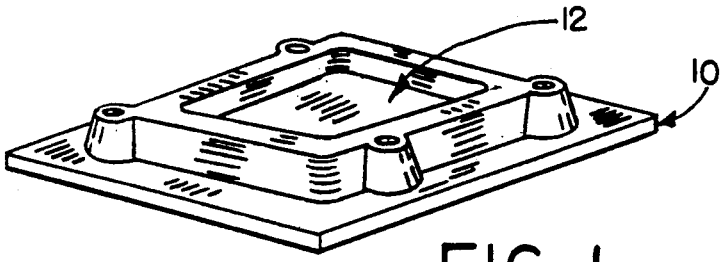
FIG. 1 is a perspective view of a die made in accordance with the principles of the present invention.
Figure 2:
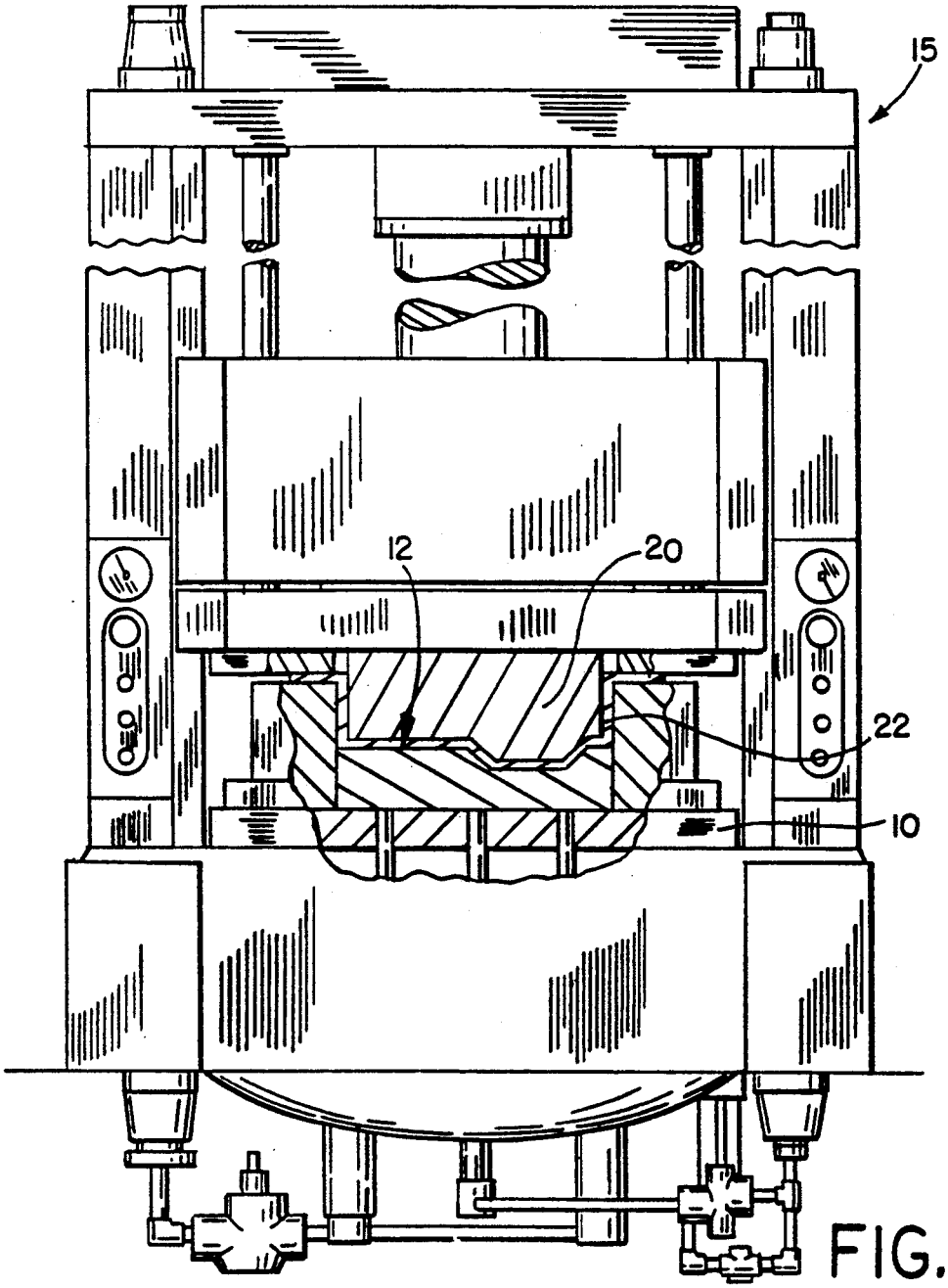
FIG. 2 is a schematic partial cross section of the die of FIG. 1 mounted in a press.

Shown in FIG. 1 is a die 10 produced utilizing applicant's tool steel. For the purposes of this specification, and the claims below, a die is defined as a tool that imparts shape to solid, molten or powdered metal because of the shape of the tool itself. Such dies are used in various press operations including blanking, drawing, forming, in die casting and in forming green powder and metallurgy compacts. Die 10 is preferably machined or ground to its final shape while the die 10 is in a pre-hardened or soft condition. Once the die 10 has been worked to its final configuration, the working surface 12 of the die 10 is then flame hardened. Illustrated in FIG. 2 is a press 15 in which die 10 is mounted. As a result of the application of pressure imparted by the press 15 upon the die 10 and the punch 20, a workpiece 22 is formed into a finished or semifinished part.

As is well-known in the art, tool steels are metallic compositions that predominately contain iron and are alloyed with various other elements such as, for example, carbon, manganese, chromium, nickel, and molybdenum. Tool steels are generally characterized by high hardness and resistance to abrasion.

The tool steel of the present invention is produced utilizing conventional melting practices to provide a tool steel having up to about 0.95 percent by weight carbon, about 0.075 to about 1.60 percent by weight manganese, about 0.020 to about 0.090 percent by weight sulfur, about 1.0 to about 2.0 percent by weight chromium and about 0.10 to about 0.50 percent by weight nickel.

Preferably, the tool steel includes copper and is killed or deoxidized utilizing primarily silicon. Also, preferably the amount of phosphorus contained in the tool steel is limited. In another preferred embodiment the tool steel includes about 0.4 to about 0.8 percent by weight carbon, about 0.090 to about 1.45 percent by weight manganese, up to about 0.050 percent by weight phosphorus, about 0.030 to about 0.080 percent by weight sulfur, at least about 0.20 percent by weight silicon, about 1.10 to about 1.90 percent by weight chromium, about 0.15 to about 0.40 percent by weight nickel and at least about 0.20 percent by weight copper. More preferably, the tool steel comprises about 0.50 to about 0.65 percent by weight carbon, about 0.090 to about 1.45 percent by weight manganese, up to about 0.050 percent by weight phosphorus, about 0.030 to about 0.080 percent by weight sulfur, about 0.30 to about 1.0 percent by weight silicon, about 1.10 to about 1.90 percent by weight chromium, about 0.15 to about 0.40 percent by weight nickel, and about 0.20 to about 0.40 percent by weight copper.

In a further preferred embodiment of the invention the tool steel comprises about 0.050 to about 0.65 percent by weight carbon, about 0.90 to about 1.45 percent by weight manganese, up to about 0.030 percent by weight phosphorus, about 0.030 to about 0.080 percent by weight sulfur, about 0.50 to about 0.80 percent by weight silicon, about 1.3 to about 1.70 percent by weight chromium, about 0.15 to about 0.40 percent by weight nickel, and at least about 0.20 percent by weight copper.

Preferably, like phosphorus, other residual elements contained in the tool steel are controlled such that iron accounts for at least about 90.0 percent by weight of the tool steel. More preferably, iron accounts for at least about 92.0 percent by weight of the tool steel. More particularly, preferably the amount of residual molybdenum contained in the steel is limited to about 0.30 percent by weight, and more preferably it is limited to about 0.20 percent by weight of the tool steel. Likewise, preferably the vanadium contained in the tool steel is limited to about 0.020 percent by weight, and more preferably, it is limited to about 0.010 percent by weight of the tool steel. Additionally, preferably the cobalt (Co) contained in the tool steel is limited to about 0.05 percent by weight of the tool steel. Additionally, preferably the tungsten (W) contained in the tool steel is limited to about 0.03 percent by weight of the tool steel. Also, preferably the titanium (Ti) contained in the tool steel is limited to about 0.001 percent by weight of the tool steel. Additionally, preferably the nitrogen (N) contained in the tool steel is limited to about 0.01 percent by weight of the tool steel. The presence of excess amounts of titanium, vanadium, nitrogen, molybdenum, tungsten, cobalt and other hardening agents may cause excessive undesirable hardening characteristics in the tool steel.

The tool steel may include aluminum (Al). However, preferably the tool steel comprises less than about 0.20 percent by weight and more preferably less than about 0.10 percent by weight aluminum. When producing castings in excess of about 120 pounds in weight preferably the aluminum does not exceed about 0.050 percent by weight. Aluminum levels in excess of 0.050 percent by weight when pouring castings over 120 pounds have been found to create pouring problems (e.g., clogged pouring nozzles). Additionally, when producing castings in excess of about 120 pounds that are destined to undergo significant amounts of machining, preferably the carbon content of the tool steel is about 0.55 percent by weight carbon.

The tool steel is preferably cast at a temperature of between about 2,825° F. and about 2,860° F. Preferably, the molds in which the tool steel is cast are stripped at about 600° F. and the tool steel is then allowed to air cool to room temperature. Anyone of a variety of steel melting techniques and/or processes may be utilized to produce the tool steel. For example, an electric furnace, basic oxygen furnace or an induction furnace may be utilized to produce the molten tool steel. Likewise, anyone of a variety of casting techniques may be employed such as top pour molds, bottom pour molds, sand molds, metal molds or a continuous caster may even be employed. Further, the tool steel may be cast into anyone of a variety of shapes such as, for example, blooms, billets, ingots, bars or into the pattern of a die. Preferably, the tool steel is cast to its near final desired shape. However, if necessary, subsequent to stripping the tool steel may be heated to a suitable temperature and hot-worked into alternative shapes.

Subsequent to stripping and cooling, the tool steel is then preferably subjected to a heat treatment schedule. The heat treatment schedule softens the tool steel thereby facilitating the cutting, machining, or other operations that may be utilized to convert the as cast tool steel into a die or similar item. More particularly, the heat treatment schedule refines the grain structure of the as cast tool steel placing it in a pre-hardened condition suitable for machining, grinding and flame hardening with substantially no distortion. Depending upon the size of the casting produced the heat treatment schedule is altered as discussed below.

I. Castings Below About 120 Pounds

The heat treatment schedule of tool steel castings below about 120 pounds includes preheating, austenization, and a double temper. Preheating is performed by heating the tool steel to an equalization temperature of about 1,175° F. to about 1,225° F., and preferably about 1,200° F. where it is held at temperature for about one to about three hours for every inch of cross section based upon the thickest or heaviest section of the tool steel, and preferably about two hours per inch of such cross section. As used herein this specification, and the claims below, the term "equalization" refers to a substantially equal, homogeneous, or uniform temperature throughout the piece or section of tool steel.

Immediately after the preheat, while still in the furnace, austenization is performed. Austenization is initially performed at an equalization temperature of about 1,625° F. to about 1,675° F., and preferably about 1,650° F. The tool steel is held at this equalization temperature for about thirty to ninety minutes per inch of cross section based upon the thickest section of the tool steel, and preferably one hour for each inch of such cross section. The tool steel is then taken down to an equalization temperature of about 1,475° F. to about 1,525° F., and preferably about 1,500° F. and held at this equalization temperature for about thirty to ninety minutes per inch of cross section based upon the thickest section of the tool steel. The tool steel is then quenched in oil having a temperature of about 125° F. to about 200° F., and preferably about 160° F. to about 175° F. The oil is preferably dynamically flowing and recirculating in order to provide good flow around the tool steel as it is being quenched. An example of a suitable oil is a quench oil sold under the designation 251-Q by Eppert Oil Company of Detroit, Mich.

The first of the tempers is performed at an equalization temperature of about 950° F. to about 1,050° F., and preferably about 1,000° F. for a period of between about thirty and about ninety minutes per inch of cross section based upon the thickest section of the tool steel, and preferably about one hour per inch of such cross section. The tool steel is then air-cooled to room temperature. The second temper is performed at an equalization temperature of about 1,075° F. to about 1,175° F., and preferably about 1,115° F. for a period of between about thirty and ninety minutes per inch of cross section and preferably about one hour per inch of such cross section. Preferably, during each of the tempers the tool steel is charged into a furnace or oven which has been preheated to temperature.

Subsequent to heat treatment, the tool steel is in a prehardened condition and it generally displays a Rockwell hardness of about 37 to about 39 on the C-scale. Preferably, the tool steel does not display a Rockwell hardness in excess of 39 on the C-scale. In this pre-hardened condition, the tool steel is relatively easy to machine, grind or otherwise process into a die such as die 10 shown in FIG. 1. Since the tool steel is relatively soft, it is unlikely to chip or break during such processing. As used herein this specification, and the claims below, "Rockwell" on the "C-scale" refers to hardness values obtained using a standard sphero-conical diamond penetrator.

II. Castings Over About 120 Pounds

The heat treatment schedule of tool steel castings above about 120 pounds comprises normalization followed by an air cooling. Specifically, the tool steel casting is heated to an equalization temperature of from about 1,575° F. to about 1,675° F., and preferably about 1,625° F. to about 1,650° F. for about thirty to ninety minutes for every inch of cross section based upon the thickest or heaviest section of the tool steel, and preferably about one hour per inch of such cross section, and then allowed to cool to room temperature.

Subsequent to heat treatment the tool steel displays a Brinell hardness number (BHN) of about 197 to about 230 utilizing a standard ball penetrator having a diameter of 0.39 inches and load of 3,000 kg.

Once the tool steel has been fully processed and finished into a die 10, the die 10 may then be post-hardened in a furnace, oven or similar heating device. Preferably, the die 10 is flame hardened and air-cooled along the working surface 12 in order to produce a Rockwell hardness on the C-scale of about 60 to about 62, with virtually no distortion. During flame hardening, case depths of between about three-sixteenths of an inch to about three-eighths of an inch may be attained on the working surface 12. Preferably, flame hardening is accomplished by heating the surface of the tool steel to a temperature of between about 1,530° F. to about 1,600° F., and preferably about 1,560° F., followed by air cooling. This flame hardening step may be carried out while the die 10 is mounted in the press 15. Similarly, the die 10 may be repair welded in the press 15 without any preheating. Applicant has found that when repairing cracks in castings such as dies made from the tool steel of the present invention, subsequent to welding and filling the crack, the repaired weld area should be lightly peened prior to flame hardening.

In order to further illustrate the invention, the following examples of preferred compositions and heat treating schedules are provided below.

EXAMPLE I

In an induction furnace a tool steel melt is formed having a composition comprising 0.60 percent by weight carbon, 0.65 percent by weight silicon, 1.2 percent by weight manganese, 0.01 percent by weight phosphorus, 0.5 percent by weight sulfur, 1.60 percent by weight chromium, 0.25 percent by weight nickel, 0.45 percent by weight copper, 0.05 percent by weight aluminum and residual amounts of nitrogen, titanium, cobalt, tungsten, vanadium and molybdenum. The tool steel melt is cast at about 2,845° F. and poured into molds which form 40 pound castings having a thickest or heaviest cross section of about two inches. The molds are stripped at a temperature of about 600° F. and then the castings are air-cooled to room temperature. Preheating is performed by heating the castings to an equalization temperature of about 1,200° F. where they are held at temperature for about four hours. Immediately after preheating, while the castings are still in the furnace, the austenization cycle is initiated. Austenization is initially performed at an equalization temperature of about 1,650° F. The castings are then held at this equalization temperature for about two hours. The castings are then taken down to an equalization temperature of about 1,500° F. and held at this equalization temperature for about two hours. The castings are then quenched in a dynamically recirculating quench oil sold by Eppert Oil Company under the designation 251-Q. The first of the tempers is performed at an equalization temperature of about 1,000° F. for a period of about two hours and then the castings are air-cooled to room temperature. The second temper is performed at an equalization temperature of about 1,115° F. for a period of about two hours. Subsequent to heat treatment the castings display a Rockwell hardness of about 38 on the C-scale. The castings are then machined into dies and flame hardened. During flame hardening the work surface of the castings are heated to a temperature of about 1,560° F. followed by air cooling. Subsequent to flame hardening the dies display a Rockwell hardness of about 62 on the C-scale.

EXAMPLE II

In an induction furnace a tool steel melt is formed having a composition comprising 0.55 percent by weight carbon, 0.65 percent by weight silicon, 1.2 percent by weight manganese, 0.01 percent by weight phosphorus, 0.5 percent by weight sulfur, 1.60 percent by weight chromium, 0.25 percent by weight nickel, 0.45 percent by weight copper, 0.05 percent by weight aluminum and residual amounts of nitrogen, titanium, cobalt, tungsten, vanadium and molybdenum. The tool steel melt is cast at about 2,845° F. and poured into molds which form 1,500 pound castings having a thickest or heaviest cross section of about ten inches. The molds are stripped at a temperature of about 600° F. and then the castings are air-cooled to room temperature. Normalization is performed by heating the castings to an equalization temperature of about 1,640° F. where they are held at temperature for about ten hours. The castings are air-cooled to room temperature. Subsequent to heat treatment the castings display a Brinell hardness number (BHN) of 200 using a standard ball penetrator having a 0.39 inch diameter and a 3,000 kg load. The castings are then machined into dies and flame hardened. During flame hardening the work surface of the castings are heated to a temperature of about 1,560° F. followed by air cooling. Subsequent to flame hardening the castings display a Rockwell hardness of about 62 on the C-scale.

It will be appreciated that although the above description has been primarily focused upon dies, the tool steel of the present invention is also well suited for use in producing various other items such as punches, knives, blades and any other variety of items where the properties of a tool steel are desired.

Although the invention has been shown and described with respect to preferred embodiments, it is obvious that equivalent alterations and modifications will occur to others skilled in the art upon reading and understanding the specification. The present invention includes all such equivalent alterations and modifications, and is limited only by the scope of the following claims.

What is claimed:

1. A metallic composition comprising at least about 92 percent by weight iron (Fe), from about 0.50 to about 5.65 percent by weight carbon (C), from about 0.090 to about 1.45 percent by weight manganese (Mn), up to about 0.030 percent by weight phosphorus (P), from about 0.030 to about 0.080 percent by weight sulfur (S), from about 1.30 to about 1.70 percent by weight chromium (Cr), from about 0.050 to about 0.80 percent by weight silicon (Si), at least about 0.20 percent by weight copper (Cu), from about 0.15 to about 0.40 percent by weight nickel (Ni) up to about 0.010 percent by weight vanadium (V), up to about 0.20 percent by weight molybdenum (Mo), less than about 0.05 percent by weight cobalt (Co), less than about 0.03 percent by weight tungsten (W), less than about 0.001 percent by weight titanium (Ti) and less than about 0.20 percent by weight aluminum (Al).

2. A metallic composition as set forth in claim 1 including about 0.20 to about 0.40 percent by weight copper (Cu).

3. A metallic composition as set forth in claim 1 including about 0.25 to about 0.35 percent by weight copper (Cu).

4. A metallic composition as set forth in claim 1 wherein said manganese (Mn) is present in a range from about 1.05 to about 1.25 percent by weight.

5. A metallic composition as set forth in claim 1 wherein said tool steel includes less than about 0.01 percent by weight nitrogen (N).

6. A method of producing a tool or die comprising the steps of:

(A) providing a section of metal comprising at least about 92 percent by weight iron (Fe), up to about 0.95 percent by weight carbon (C), about 0.075 to about 1.6 percent by weight manganese (Mn), about 0.020 to about 0.090 percent by weight sulfur (S), about 1 to about 2 percent by weight chromium (Cr) and about 0.10 to about 0.50 percent by weight nickel (Ni);

(B) austenitizing such metal; and (C) tempering such metal;

wherein during said austenitizing step (B) such metal is initially heated to an equalization temperature of from about 1,625° F. to about 1,675° F. for a period of from about one to about three hours for about every inch of cross section measured at the thickest portion of such metal, then such metal is heated to a temperature of from about 1,475° F. to about 1,525° F. for from about thirty to about ninety minutes for about every inch of cross section measured at the thickest portion of such metal and then such metal is oil quenched.

7. A method as set forth in claim 6 wherein during said austenization step (B) such metal is heated to an equalization temperature of about 1,650° for a period of about one hour for about each inch of cross section at the thickest portion of such metal and then such metal is heated to an equalization temperature of about 1,500° F. for about one hour for each inch of cross section at the thickest portion of such metal and then, oil quenched.

8. A method as set forth in claim 7 wherein during said step of oil quenching such oil is heated to a temperature of from about 125° F. to about 200° F.

9. A method as set forth in claim 8 wherein during said step of oil quenching such oil is heated to a temperature of from about 160° F. to about 175° F.

10. A method as set forth in claim 6 wherein during said tempering step (C) such metal is heated to an equalization temperature of from about 950° F. to about 1,050° F. for about from thirty to about ninety minutes for about each inch of cross section measured at the thickest portion of such metal.

11. A method as set forth in claim 6 wherein during said tempering step (C) such metal is heated to an equalization temperature of about 1,000° F. for about one hour for about every inch of cross section measured at the heaviest portion of such metal and subsequent to said tempering step (C) such metal is air-cooled to room temperature.

12. A method as set forth in claim 6 including the step of:

(D) tempering such metal for a second time;

wherein during said tempering step (D) such metal is heated at an equalization temperature of from about 1,075° F. to about 1,175° F. for a period of about thirty to about ninety minutes for about each inch of cross section measured at the thickest portion of such metal.

13. A method as set forth in claim 6 including the step of:

(D) tempering such metal for a second time;

wherein during said tempering step (D) such metal is heated at an equalization temperature of about 1,115° F. for a period of about one hour for about every inch of cross section measured at the thickest portion of such metal and then air-cooled to room temperature.

14. A method as set forth in claim 6 wherein prior to said austenitizing step (B) such metal is preheated to an equalization temperature of from about 1,175° F. to about 1,225° F. for from about one to about three hours for about every inch of cross section measured at the heaviest portion of such metal.

15. A method as set forth in claim 6 wherein prior to said austenitizing step (B) such metal is preheated to an equalization temperature of about 1,200°F. for about two hours for about every inch of cross section measured at the heaviest portion of such metal.

16. A method of producing a tool or die consisting of the steps of:

(A) providing a section of metal having a weight in excess of about 120 pounds and comprising at least about 92 percent by weight iron (Fe), from about 0.050 to about 0.65 percent by weight carbon (C), from about 0.090 to about 1.45 percent by weight manganese (Mn), up to about 0.030 percent by weight phosphorus (P), from about 0.030 to about 0.080 percent by weight sulfur (S), from about 1.30 to about 1.70 percent by weight chromium (Cr), from about 0.50 to about 0.80 percent by weight silicon (Si), at least about 0.20 percent by weight copper (Cu), from about 0.15 to about 0.40 percent by weight nickel (Ni) up to about 0.010 percent by weight vanadium (V), up to about 0.20 percent by weight molybdenum (Mo), less than about 0.05 percent by weight cobalt (Co), less than about 0.03 percent by weight tungsten (W), less than about 0.001 percent by weight titanium (Ti) and less than about 0.20 percent by weight aluminum (Al);

(B) normalizing such section of metal at an equalization temperature of from about 1,575° F. to about 1,675° F. for about every inch of cross section measured at the heaviest portion of such metal; and (C) air cooling such section of metal to room temperature.

17. A method as set forth in claim 16 wherein during said step (B) such section of metal is heated to an equalization temperature of from about 1,625° F. to about 1,650° F. for a period of sixty minutes for about each inch of cross section measured at the thickest portion of such section of metal.

18. A method as set forth in claim 6 including the steps of:

(E) machining such metal so as to structurally form such die or tool; and (F) flame hardening such metal.

19. A method as set forth in claim 17 including the steps of:

(D) machining such section of metal so as to structurally form such die or tool; and (E) flame hardening such section of metal; said flame hardening step including the steps of heating the surface of such section of metal to a temperature of from about 1,530° F. to about 1,600° F. followed by air cooling.

* * * * *